United States Patent [19]

Nishikawa

[11] Patent Number: 4,915,582

[45] Date of Patent: Apr. 10, 1990

[54] ROTARY TURBINE FLUID PUMP

[75] Inventor: Yukihiro Nishikawa, Gunma, Japan

[73] Assignee: Japan Electronic Control Systems Company, Limited, Isezaki, Japan

[21] Appl. No.: 230,996

[22] Filed: Aug. 11, 1988

[30] Foreign Application Priority Data

Aug. 12, 1987 [JP] Japan ..... 62-201494

[51] Int. Cl.[4] ..... F01D 3/00

[52] U.S. Cl. ..... 415/55.1; 415/106

[58] Field of Search ..... 415/53 T, 106, 213 T, 415/55.1; 417/365, 424.1, 424.2

[56] References Cited

U.S. PATENT DOCUMENTS 4,465,436 8/1984 Schönwald ..... 417/271
4,586,877 5/1986 Watanabe et al. ..... 415/213 T
4,676,722 6/1987 Marchal et al. ..... 416/188

FOREIGN PATENT DOCUMENTS 265084 10/1926 Italy ..... 415/106

*Primary Examiner*—Everette A. Powell, Jr.
*Attorney, Agent, or Firm*—Foley & Lardner, Schwartz, Jeffery, Schwaab, Mack, Blumenthal & Evans

[57] ABSTRACT

A rotary turbine fluid pump employs unique configurations of turbine vane receptacle opening and turbine vanes. The turbine vane receptacle is connected to a circumferentially extending fluid path, in which free ends of turbine vanes are inserted for pressurization of the fluid therein. The turbine vane receptacle operation has pair of surfaces opposing and spaced apart to each other. Each surface is radially tapered toward the center at a first inclination rate. Each turbine vane is provided edges opposing the surfaces of the turbine vane receptacle operation. The edges are correspondingly tapered at a second rate which is determined so that the spacing between the surface and the edge is gradually increased toward the rotation center of the turbine. This construction minimizes friction increasing when the pressure balance in floating seal formed between the surface and the edge is destroyed.

30 Claims, 4 Drawing Sheets

ROTARY TURBINE FLUID PUMP

BACKGROUND OF THE INVENTION

1. Field of the Invention

The present invention relates generally to a rotary turbine fluid pump for pressurizing and circulating fluid. More specifically, the invention relates to a rotary turbine fluid pump suitable for use as a fuel pump for supplying a fuel to an automotive internal combustion engine.

2. Description of the Background Art

Conventionally, roller vane type fuel pumps have been used as a fuel pump for an internal combustion engine. In the recent days, non-volume type rotary turbine fuel pumps are inclined to be used in place of the conventionally used roller vane type fuel pumps.

The rotary turbine fuel pump has a turbine vane rotatingly driven by means of an electric motor. The turbine vane is disposed within a path of the fuel to pressurize the fuel introduced into the fuel path. A substantially small gap is formed between the inner periphery of the fuel path and the edge of the turbine vane. The gap is sealed by establishing floating seal. When leakage of fuel through the gap occurs, the performance can be necessarily lowered. Therefore, in order to maintain satisfactory performance, gap has to be small enough to successfully establish the floating seal.

In such rotary turbine fuel pump, problem is encountered when pressure balance in the floating seal is destroyed. Namely, when the pressure balance is destroyed, the turbine blade is depressed onto the inner periphery of the fuel path to substantially increase friction to cause lowering of the pump performance and wearing of the blade.

SUMMARY OF THE INVENTION

Therefore, it is an object of the present invention to provide a rotary turbine fluid pump which avoid the aforementioned influence of pressure difference in seal and minimize increasing of friction even when pressure balance in the seal is destroyed.

In order to accomplish aforementioned and other objects, a rotary turbine fluid pump, according to the present invention, employs unique configurations of turbine vane receptacle opening and turbine vanes. The turbine vane receptacle is connected to a circumferentially extending fluid path, in which free ends of turbine vanes are inserted for pressurization of the fluid therein. The turbine vane receptacle operation has pair of surfaces opposing and spaced apart to each other. Each surface is radially tapered toward the center at a first inclination rate. Each turbine vane is provided edges opposing the surfaces of the turbine vane receptacle operation. The edges are correspondingly tapered at a second rate which is determined so that the spacing between the surface and the edge is gradually increased toward the rotation center of the turbine.

According to one aspect of the invention, a rotary turbine fluid pump comprises a rotary turbine having a plurality of turbine vanes which are arranged on the outer circumference thereof and being rotatingly driven by means of a driving means, the rotary turbine having a pair of surfaces at its both axis ends, a pump housing defining therein a pumping chamber connected to an inlet for introducing fluid therethrough and to an outlet for discharging pressurized fluid therefrom, the pump housing having wall sections mating portions mating with the surfaces of the turbine, means for defining sealing chambers between the surfaces and the wall sections for establishing floating seal therebetween, and means for introducing pressurized fluid into the sealing chambers, which defines pressurized fluid path connected to the sealing chambers and gradually reducing path area toward the sealing chamber.

The sealing portion defining means may comprise a portion of the wall section extending substantially parallel to corresponding portion of mating surface of the turbine with a clearance serving as the sealing chamber. Preferably, the sealing chamber joins with the pressurized fluid path to introduce pressurized fluid therethrough. The pressurizing fluid introducing means may comprise a portion of the wall section and the surface of the turbine, at least one of which is inclined in such a direction that the clearance defined therebetween is increased toward the center. In such case, the portion of the wall section is inclined to gradually increase the clearance toward the center, and the difference of clearance at inner and outer ends thereof is in a range of 5 $\mu$m to 20 $\mu$m, more preferably in a range of 8 $\mu$m to 10 $\mu$m.

In the alternative, the surface of the turbine is inclined to gradually increase the clearance toward the center, and the difference of clearance at inner and outer ends thereof is in a range of 2 $\mu$m to 15 $\mu$m, more preferably in a range of 4 $\mu$m to 8 $\mu$m.

Preferably, the turbine is formed of a reinforced plastic. The reinforced plastic is preferably a glass matrix composition composed of glass matrix of 40%, phenol resin of 40% and binder of 20%, for example.

In the preferred construction, the rotary turbine fluid pump further comprises means for recirculating pressurized fluid discharged from the outlet to the pressurized fluid path, which pressurized fluid recirculating means is connected to the pressurized fluid path. Also, the rotary turbine fluid pump as set forth in claim 1, which further comprises a cylindrical casing housing therein the driving means and defining an internal space communicated with the pumping chamber via the discharge outlet.

Furthermore, the rotary turbine fluid pump further comprises a stationary shaft extending along a rotation axis of the turbine and rotatably supporting a rotary element of the driving means and the turbine for rotation thereabout. In the preferred construction, the turbine is axially movable along the stationary shaft.

According to another aspect of the invention, a rotary turbine fluid pump comprises a cylindrical casing body, a driving motor assembly disposed within the casing body, a pump housing secured to one end of the cylindrical casing body, the pump housing having axially spaced first and second wall sections, the first and second wall sections being cooperated to each other for defining an essentiallly annular pump chamber communicating with an inlet and an outlet, and a turbine receptacle opening joined with the pumping chamber at the outer end thereof, a rotary turbine having an essentially solid disc shaped turbine body and a plurality of turbine vanes which are arranged on the outer circumference of the turbine, the turbine being drivingly associated with the driving motor assembly to be driven by the driving torque of the latter, the turbine body having first and second surfaces opposing the first and second wall sections of the pump housing, the first and second wall sections of the pump housing and the first and second surfaces of the turbine being cooperative to each other for defining an annular sealing chambers at both axial sides of the turbine, and the first and second wall sections of the pump housing and the first and second surfaces of the turbine being further cooperative to define a fluid path communicating with the sealing chamber for introducing pressurized fluid to the latter for establishing floating seal therein, the fluid path having a first fluid path area substantially equal to than in the sealing chamber at the end joining with the sealing chamber and a second fluid path area greater than the first fluid path area at the end remote from the sealing chamber.

In the construction set forth above, it is preferred that the sealing chamber is oriented in the vicinity of the pumping chamber and joined with the outer end of the fluid path. The path area of the fluid path gradually increased inwardly from the first path area to the second path area. The path area of the fluid path increases from the first area to the second area in linear fashion.

The first wall section of the pump housing opposes the first surface of turbine, and one of the first wall section and the first surface inclines inwardly to gradually increase spacing to the other. Similarly, the second wall section of the pump housing opposes the second surface of turbine, and one of the second wall section and the second surface inclines inwardly to gradually increase spacing to the other.

According to a further aspect of the invention, a rotary turbine fluid pump comprises a cylindrical casing body, a driving motor assembly disposed within the casing body, a pump housing secured to one end of the cylindrical casing body, the pump housing having axially spaced first and second wall sections, the first and second wall sections being cooperated to each other for defining an essentiallly annular pump chamber communicating with an inlet and an outlet, and a turbine receptacle opening joined with the pumping chamber at the outer end thereof, a rotary turbine having an essentially solid disc shaped turbine body and a plurality of turbine vanes which are arranged on the outer circumference of the turbine, the turbine being drivingly associated with the driving motor assembly to be driven by the driving torque of the latter, the turbine body having first and second surfaces opposing the first and second wall sections of the pump housing, the turbine being axially movable along a rotation axis thereof, and the first and second wall sections of the pump housing and the first and second surfaces of the turbine cooperating to specify a contact area for allowing frictional contact between opposing pair of first wall section and the first surface and the second wall section and the second surface at the occurrence of axial shift of the turbine.

In the practical construction, the first and second walls and the first and second surfaces are so configurated to cause frictional contact at the portion where the sealing chambers are defined.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
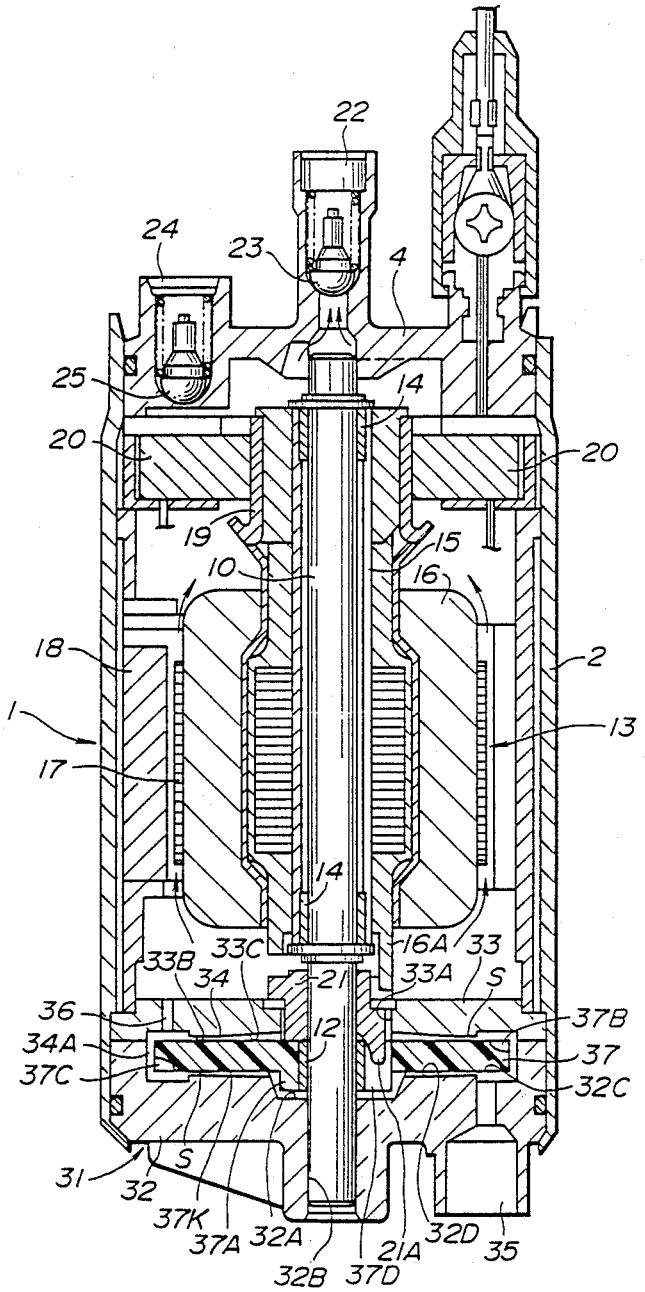
FIG. 1 is a sectional view showing overall structure of the preferred embodiment of a rotary turbine fluid pump according to the present invention.

Referring now to the drawings, particularly to FIG. 1, the preferred embodiment of a rotary turbine fluid pump has a casing which is generally represented by the reference numeral "1". The casing 1 comprises a cylindrical casing body 2, a pump housing 3 and a cover 4. The cover 4 is pluged in the upper end of the casing body 2 in liquid tight fashion. On the other hand, the pump housing 3 is pluged in the lower end of the casing body 2 in liquid tight fashion. Therefore, upper and lower ends of the cylindrical casing body 2 are closed by the cover 4 and the pump housing 3.

The pump housing 3 is formed into a disc-shaped configuration and comprises an upper segment 33 and a lower segment 32. The upper and lower segments 33 and 32 are assembled to each other for forming the disc-shaped pump housing 3. The upper segment 33 is formed with a center opening 33A. The lower segment 32 is formed with a turbine boss receptacle recess 32A and a center opening 32B which is connected to the turbine boss receptacle recess. The center openings 33A and 32B of the upper and lower segments 33 and 32 are aligned to each other to define a stationary shaft receptacle for receiving the lower end of a stationary shaft 10. The upper end of the stationary shaft 10 is fixed to the center boss section 4A of the cover 4

A pumping chamber 34 in an essentially square or rectangular configuration in section is defined between the upper and lower segments 33 and 32. The pumping chamber 34 communicates with an inlet port 35 and with an internal space of the cylindrical casing body 2 via a discharge opening 36. The pumping chamber 34 also communicates with a turbine receptacle. The pump chamber 34 extends circumferentially in a angular range of about 340° and communicates with the inlet port 35 at one end and the discharge opening 36 at the other end.

Figure 2:
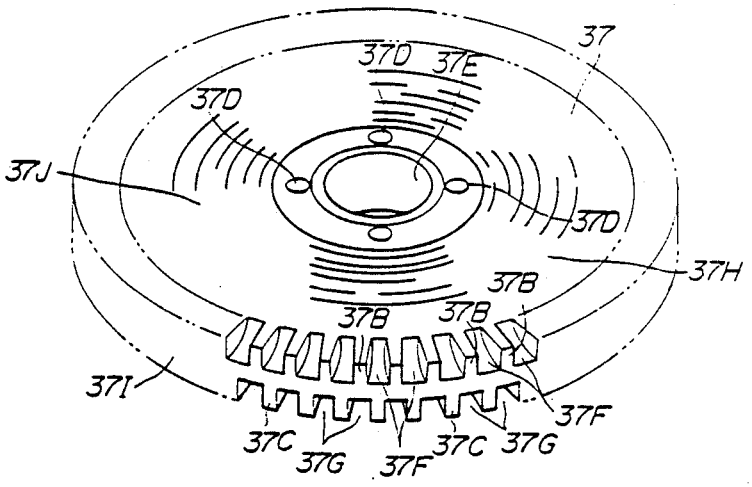
FIG. 2 is an explanatory and enlarged perspective view of a rotary turbine employed in the preferred embodiment of the rotary turbine fluid pump of FIG. 1.

A turbine 37 is disposed within the turbine receptacle, which turbine 37 has a plurality of turbine vanes 37B and 37C. As seen from FIG. 2, the turbine 37 is formed into a disc-shaped configuration. The turbine 37 has a cylindrical boss section 37A extending downwardly at the center portion thereof. A center opening 37E is formed through the cylindrical boss section 37A to pass therethrough the stationary shaft 10. A sleeve bearing 12 is interposed between the outer periphery of the stationary shaft and the inner periphery of the center opening 37E so as to allow smooth rotation of the turbine 37 about the stationary shaft 10. A plurality of engaging opening 37D which opens upwardly are formed in the boss section 37A. These engaging openings 37D are designed to establish connection with the lower end of a drive shaft section 16A of an electric motor 13 via a joint member 21.

The turbine vanes 37B and 37C are defined by recess 37F and 37G formed on the upper and lower peripheral edges of the disc-shaped turbine body. As seen from FIG. 1, the turbine vanes 37B and 37C are placed within the pumping chamber 34. The peripheral edge of the turbine vanes 37B and 37C are positioned in spaced away from the peripheral surface of the pumping chamber 34 while leaving a small clearance to define a fluid path 34A. The annular turbine body to be disposed within the turbine receptacle of the pump housing 3 is of solid construction and is designed to define a small clearance between the peripheral surface of the turbine receptacle for establishing a floating seal. The detailed construction of the turbine body and the turbine receptacle will be discussed later.

In practice, the turbine 37 is formed of a reinforced composition containing about 40% of glass matrix, about 40% of phenol resin and about 20% of binder. Such reinforced plastic composition turbine is advangeously introduced for its light weight which may aid for reduction of overall weight of the pump.

The electric motor 13 comprises a rotor 16 which is rotatably supported on the stationary shaft 10 via a pair of ring shaped sleeve bearings 14 and a cylindrical sleeve 15, a multi-pole coil 17 wound around the rotor, a stator 18 fixedly secured on the inner periphery of cylindrical casing body 2, a commutator 19 having a plurality of commutator elements, number of which corresponds to the number of poles provided in the coil, and a pair of brushes 20 slidingly contacting with the commutator. The rotor 16 has a downward extension 16A engaged to the joint member 21. The multi-pole coil 17 is electrically connected to an electric power source via a lead wire 17A, the brush 20, the commutator 19, a conductor 17B and the rotor body to create magnetic field, The magnetic field created by the coil 17 is influenced by the stator 18 to cause rotation of the rotor 16. As a result, the rotor 16 is rotatingly driven.

The joint member 21 has a cylindrical construction and rotatably supported on the stationary shaft 10. The joint member 21 is disposed between the rotor 16 and the turbine 37 so as to transmit rotational force created by the electric motor 13 to the turbine for rotatingly drive the latter. In order to establish co-rotative engagement, the joint member 21 has a plurality of downward extensions 21A which engage with the engaging opening 37D of the turbine 37. As seen from FIG. 1, the extension 21 is formed slightly smaller than the engaging opening 37D so as to define a clearance between the inner periphery of the engaging opening 37D. The clearance defined between the extension 21 and the inner periphery of the engaging opening 37D serves for introducing pressurized fluid to the substantially small clearance defined between the turbine body and the turbine receptacle for establishing the floating seal.

A clearance defined between the outer periphery of the rotor body and the stator 18 and stator mounting bracket 18A serves as fluid path for allowing the pressurized fluid introduced through the discharge opening 36 from the pump chamber 34. The pressurized fluid past the clearance between the rotor 16 and the stator 18 and the stator mounting bracket 18A is discharged through an outlet port 22 formed in the cover 4, in which a surge controlling one way check valve 23 is provided. The cover 4 is also formed with a relief port 24 having a pressure relief valve 24A for relieving excessive pressure.

Figure 3:
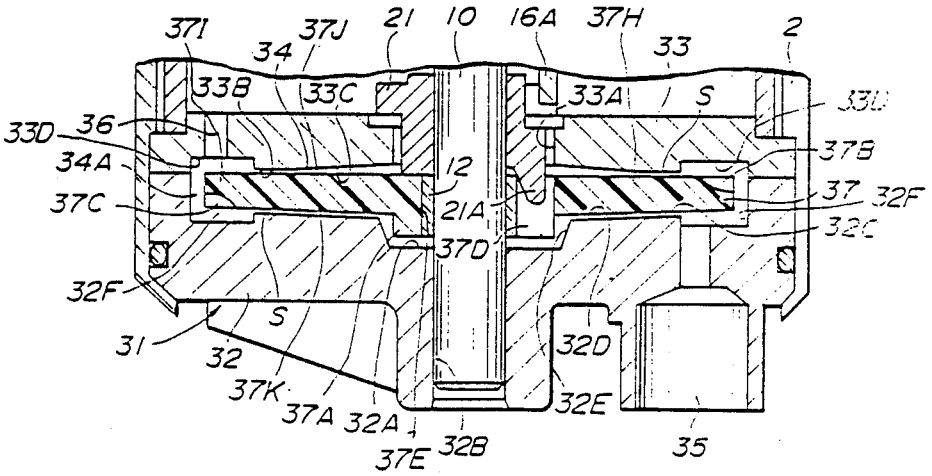
FIG. 3 is a an enlarged sectional view of the rotary turbine pump of FIG. 1, showing the major portion thereof.

FIG. 3 shows detailed construction of the preferred construction of the pump housing 3 in cooperation with the turbine 37. Detailed construction of the pump housing 3 and the turbine 37 will be discussed herebelow with reference to FIGS. 3, 4, 5 and 6.

Figure 4:
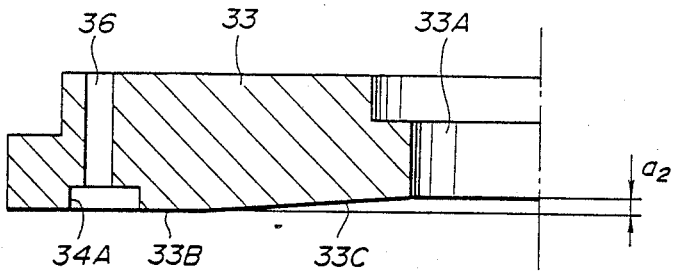
FIG. 4 is a further enlarged section showing upper section of a turbine vane receptacle opening.

As seen from FIGS. 3 and 4, the upper segment 33 of the pump housing 3 is formed into generally annular disc-shaped configuration defining the center opening 33A to receive the stationary shaft 10 and the cylindrical joint member 21. As seen, the inner diameter of the center opening 33A is slightly greater than the outer diameter of the associated section of the joint member 21 so as to define a pressurized fluid path which communicates the internal space of the cylindrical casing body 2 with the turbine receptacle opening. An essentially ring-shaped and cross-sectionally rectangular groove 33D is formed along and in the vicinity of the circumferential edge of the upper segment 33. The groove 33D forms part of the pump chamber 34 and thus extends in the angular range of 340°. The groove 33D communicates with the discharge opening 36, at one circumferential end. Along the inner edge of the groove 33D, an annular seal plane 33B is formed. The annular seal plane 33B is essentially parallel to the essentially horizontally extending upper surface of the upper segment 33. As clearly seen from FIG. 4, the radial width of the annular seal plane 33B is relatively short. The inner end of the annular seal plane 33B joins with a tapered section 33C which ascents radially and inwardly. The taper angle of the tapered section 33C is so selected that the height level at the inner end of thereof, at which the tapered section joins with the center opening 33A, is higher than the outer end in a magnitude of $a_2$. Preferably, the dimension $a_2$ is in a range of 5 μm to 20 μm, preferably in a range of 8 μm to 10 μm.

Figure 5:
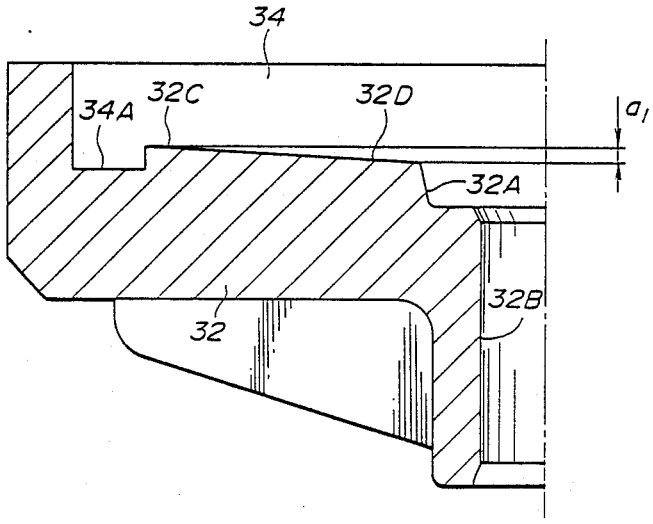
FIG. 5 is a further enlarged section showing lower section of the turbine receptacle opening.
Figure 6:
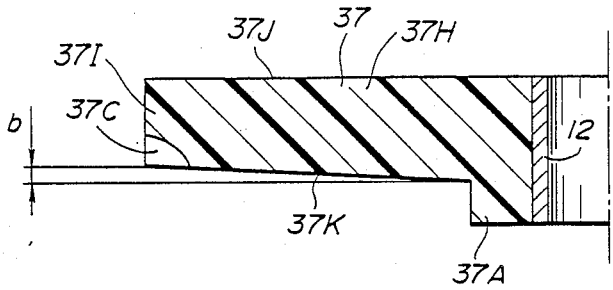
FIG. 6 is a further enlarged section of a turbine vane to be received within the turbine receptacle opening.

On the other hand, as seen from FIGS. 3 and 5, the lower segment 32 is formed with a turbine receptacle recess which is generally represented by the reference numeral "32E". The turbine receptacle recess 32E includes the boss receptacle recess 32A and annular and circumferentially extending groove 32F. The groove 32F has rectangular cross-section and oriented in the vicinity of the outer peripheral edge of the lower segment 32. This groove 32F has the same radial width to the groove 33D and thus forms part of the pump chamber 34. Therefore, it extends in the angular range of about 340°. The groove 33D communicate with the inlet port 35 which is connected to a fluid source, at one circumferential end which is opposite end to the end at which the groove 33D communicate with the discharge opening 36.

Between the inner edge of the groove 32F and the boss receptacle recess 32A, a radially tapered plane 32D with an annular seal plane 32C is formed. The annular seal plane 32C extends along the inner edge of the groove 32F. On the other hand, the tapered section 32D radially and inwardly descends in such a manner that the height level at the inner edge is lower than the outer edge, at which the tapered section joins with the annular seal plane 32C in a magnitude of $a_1$. Similarly to the lower segment 32, the dimension $a_1$ is in a range of 5 μm to 20 μm, preferably in a range of 8 μm to 10 μm.

As set forth, the turbine 37 has an annular ring shaped turbine body section 37H and a turbine vane section 37I in which the turbine vanes 37B and 37C are formed. The turbine body section 37H has essentially solid construction and extends radially and outwardly from the center boss section 37A. As will be seen from FIG. 6, the turbine 37 has an upper surface 37J and a lower surface 37K. The upper surface 37J mates with the inner or lower plane of the upper segment 33 at the turbine body section 37H. The lower surface 37K mates the inner or upper plane of the lower segment 32 at the turbine body section 37H. As seen, the upper surface 37J extends substantially horizontal. On the other hand, the lower surface 37K radially and outwardly ascends in such a manner than the height level at the outer end of the lower surface is higher than the inner end at a magnitude b. The ascending magnitude in radially outward direction is in a range of 2 μm to 15 μm and preferably in a range of 4 μm to 8 μm.

As seen from FIG. 3, the turbine vane section 37I are positioned within the pumping chamber 34. The circumferential end portion of turbine body section 37H in the vicinity of the turbine vane section 37I forms the seal portion in cooperation with the annular seal planes 33B and 32C. At the seal portion, the upper and lower surfaces 37J and 37K are spaced from the seal planes 33B and 32C leaving substantially small clearance in a magnitude of 5 μm to 20 μm, preferably in a magnitude of 8 μm to 10 μm. At the portion inside of the seal portion the clearance between the upper and lower surfaces 37J and 37K and the seal planes 33B and 32C gradually increases toward the center, at which the clearance defined between the upper and lower surfaces 37J and 37K and the tapered planes 33C and 37E, communicates with the inner space of the casing body 2 via the engaging openings 37D. The pressurized fluid introduced into the clearance serves for establishing floating seal at the seal portion. This floating seal not also serves for preventing the fluid in the pumping chamber 34 from leaking but also for supporting the turbine 37 in floating condition.

In the construction of the preferred embodiment set forth above, even when the pressure difference is creased between the fluid in the clearance between the lower surface 33C of the upper segment 33 and the upper surface 37J of the turbine 37 and the clearance between the upper surface 32D of the lower segment 32 the lower surface 37K of the turbine to cause axial shift of the turbine, frictional contact between the mating surfaces between the turbine receptacle opening and the turbine occurs only at the limited area. Namely, frictional contact occurs only at the seal portion. Therefore, even in such case, increase of friction will not be substantial to cause lowering pumping performance.

In order to determine the preferred configuration of the turbine 37, the inventors have made various experiments. First experiment was performed by utilizing conventional turbine which has substantially horizontal upper and lower surfaces. Even with the conventional turbine, the shown construction of the turbine receptacle opening was effective for preventing substantial increase of friction. However, in such case, fluid flow amount fluctuates in substantial level. In the second experiment, the turbine was so configurated to conform with the turbine receptacle opening by providing ascending tapered surface on the upper surface at substantially equal inclination to that of the tapered section 33C of the upper segment 33. As a result of the second experiment, it was found that, with the construction of the turbine substantially conforming the turbine receptacle opening set forth above, the turbine is provided a tendency to shift upwardly to cause breakage of the seal layer and thus cause substantial increase of the friction.

The preferred configuration of the turbine did not cause fluctuation of the fluid flow amount and breakage of the seal layer and thus exhibited good performance. From the experiment utilizing the preferred configuration of the turbine, the configuration of the clearances defined between the lower and upper surfaces of the turbine receptacle opening and the upper and lower surfaces of the turbine, which gradually decreases outwardly exhibits good pressurized fluid delivery performance to supply pressurized fluid to the seal portion for satisfactorily establish the floating seal. Furthermore, as set forth, even when axial shift of the turbine occurs, the limited contact area at the seal portion will prevent the turbine from contacting at whole surface which creates substantial increase of friction.

Figure 7:
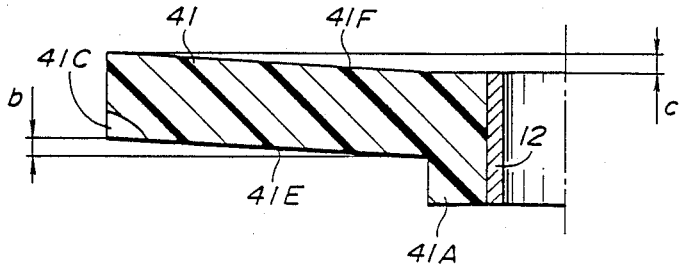
FIG. 7 is a section showing modified configuration of turbine vane.

FIG. 7 shows another preferred configuration of the turbine which is generally represented by the reference numeral "41". In this embodiment, the upper surface 41F of the turbine 41 descends radially and inwardly. The descending magnitude c is in a range of 2 μm to 15 μm, and preferable in a range of 4 μm to 8 μm. With this construction of the turbine, greater clearance is formed between the upper surface 41F of the turbine 41 and the lower surface of the upper segment. This may increase tendency of downward shift of the turbine. Because the axial shift of the turbine tends to occur in upward direction, the shown arrangement may eliminate chance of axial shifting of the turbine.

Therefore, the present invention fulfills all of the objects and advantages sought therefore.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A rotary turbine fluid pump comprising:

a rotary turbine having a plurality of turbine vanes which are arranged on the outer circumference thereof and which are rotatingly driven by means of a driving means, said rotary turbine having a pair of surfaces at its both axis ends;

a pump housing defining therein a pumping chamber connected to an inlet for introducing fluid therethrough and to an outlet for discharging pressurized fluid therefrom, said pump housing having wall sections mating portions mating with said surfaces of said turbine;

means for defining sealing chambers between said surfaces and said wall sections for establishing a floating seal therebetween; and means for introducing pressurized fluid into said sealing chambers, which defines pressurized fluid path connected to said sealing chambers and gradually reducing path area toward said sealing chamber.

2. A rotary turbine fluid pump as set forth in claim 1, wherein said sealing portion defines means comprises a portion of said wall section extending substantially parallel to a corresponding portion of the mating surface of said turbine with the clearance therebetween serving as said sealing chamber.

3. A rotary turbine fluid pump as set forth in claim 2, wherein said sealing chamber joins with said pressurized fluid path to introduce pressurized fluid therethrough.

4. A rotary turbine fluid pump as set forth in claim 3, wherein said pressurizing fluid introducing means comprises a portion of said wall section and said surface of said turbine, at least one of which is inclined in such a direction that the clearance defined therebetween is increased toward the center.

5. A rotary turbine fluid pump as set forth in claim 4, wherein said portion of said wall section is inclined to gradually increase said clearance toward the center, and the difference of clearance at inner and outer ends thereof is in a range of 5 μm to 20 μm.

6. A rotary turbine fluid pump as set forth in claim 5, wherein said difference is in a range of 8 μm to 10 μm.

7. A rotary turbine fluid pump as set forth in claim 4, wherein said surface of said turbine is inclined to gradually increase said clearance toward the center, and the difference of clearance at inner and outer ends thereof is in a range of 2 μm to 15 μm.

8. A rotary turbine fluid pump as set forth in claim 7, wherein said difference is in a range of 4 μm to 8 μm.

9. A rotary turbine fluid pump as set forth in claim 1, wherein said turbine is formed of a reinforced plastic.

10. A rotary turbine fluid pump as set forth in claim 9, wherein said reinforced plastic is preferably a glass matrix composition composed of glass matrix of 40%, phenol resin of 40% and binder of 20%.

11. A rotary turbine fluid pump as set forth in claim 1, which further comprises means for recirculating pressurized fluid discharged from said outlet to said pressurized fluid path, which pressurized fluid recirculating means is connected to said pressurized fluid path.

12. A rotary turbine fluid pump as set forth in claim 1, further comprising a cylindrical casing which houses therein said driving means and which defines an internal space communicated with said pumping chamber via said discharge outlet.

13. A rotary turbine fluid pump as set forth in claim 12, further comprising a stationary shaft extending along a rotation axis of said turbine and rotatably supporting a rotary element of said driving means and said turbine for rotation thereabout.

14. A rotary turbine fluid pump as set forth in claim 13, wherein said turbine is axially movable along said stationary shaft.

15. A rotary turbine fluid pump comprising:

a cylindrical casing body;

a driving motor assembly disposed within said casing body;

a pump housing secured to one end of said cylindrical casing body, said pump housing having axially spaced first and second wall sections, said first and second wall sections cooperating with each other to define an essentially annular pump chamber communicating with an inlet and an outlet, and a turbine receptacle opening joined with said pumping chamber at the outer end thereof;

a rotary turbine having an essentially solid disc-shaped turbine body and a plurality of turbine vanes which are arranged on the outer circumference of the turbine, said turbine being drivingly associated with said driving motor assembly to be driven by the driving torque of the latter, said turbine body having first and second surfaces opposing said first and second wall sections of said pump housing;

said first and second wall sections of said pump housing and said first and second surfaces of said turbine being cooperative with each other to define an annular sealing chambers at both axial sides of said turbine; and said first and second wall sections of said pump housing and said first and second surfaces of said turbine being further cooperating to define a fluid path communicating with said sealing chamber for introducing pressurized fluid to the latter for establishing a floating seal therein, said fluid path having a first fluid path area substantially equal to that in said sealing chamber at the end joining with said sealing chamber and a second fluid path area greater than said first fluid path area at the end remote from said sealing chamber.

16. A rotary turbine fluid pump as set forth in claim 15, wherein said sealing chamber is oriented in the vicinity of said pumping chamber and joined with the outer end of said fluid path.

17. A rotary turbine fluid pump as set forth in claim 16, wherein said path area of said fluid path gradually increases inwardly from said first path area to said second path area.

18. A rotary turbine fluid pump as set forth in claim 17, wherein said path area of said fluid path increases from said first area to said second area in linear fashion.

19. A rotary turbine fluid pump as set forth in claim 17, wherein said first wall section of said pump housing opposes said first surface of said turbine, and one of said first wall section and said first surface inclines inwardly to gradually increase spacing therebetween.

20. A rotary turbine fluid pump as set forth in claim 17, wherein said second wall section of said pump housing opposes said second surface of turbine, and one of said second wall section and said section surface inclines inwardly to gradually increase spacing therebetween.

21. A rotary turbine fluid pump comprising:

a cylindrical casing body;

a driving motor assembly disposed within said casing body;

a pump housing secured to one end of said cylindrical casing body, said pump housing having axially spaces first and second wall sections, said first and second wall sections cooperating with each other to define an essentially annular pump chamber communicating with an inlet and an outlet, and a turbine receptacle opening joined with said pumping chamber at the outer end thereof;

a rotary turbine having an essentially solid disc-shaped turbine body and a plurality of turbine vanes which are arranged on the outer circumference of the turbine, said turbine being drivingly associated with said driving motor assembly to be driven by the driving torque of the latter, said turbine body having first and second surfaces opposing said first and second wall sections of said pump housing;

said turbine being axially movable along a rotation axis thereof; and said first and second wall sections of said pump housing and said first and second surfaces of said turbine cooperating to specify a contact area for allowing frictional contact between opposing pairs of first wall section and said first surface and said second wall section and said second surface at the occurrence of axial shift of said turbine.

22. A rotary turbine fluid pump as set forth in claim 21, wherein said first and second wall sections of said pump housing and said first and second surfaces of said turbine cooperating with each other to define an annular sealing chambers at both axial sides of said turbine; and said first and second wall sections of said pump housing and said first and second surfaces of said turbine further cooperating to define a fluid path communicating with said sealing chamber for introducing pressurized fluid to the latter for establishing floating seal therein, said fluid path having a first fluid path area substantially equal to that in said sealing chamber at the end joining with said sealing chamber and a second fluid path area greater than said first fluid path area at the end remote from said sealing chamber.

23. A rotary turbine fluid pump as set forth in claim 22, wherein said first and second walls and said first and second surfaces are so configured to cause frictional contact at the portion where said sealing chambers are defined.

24. A rotary turbine fluid pump as set forth in claim 22, wherein said sealing chamber is oriented in the vicinity of said pumping chamber and joined with the outer end of said fluid path.

25. A rotary turbine fluid pump as set forth in claim 24, wherein said path area of said fluid path gradually increases inwardly from said first path area to said second path area.

26. A rotary turbine fluid pump as set forth in claim 25, wherein said path area of said fluid path increases from said first area to said second area in linear fashion.

27. A rotary turbine fluid pump as set forth in claim 25, wherein said first wall section of said pump housing opposes said first surface of turbine, and one of said first wall section and said first surface inclines inwardly to gradually increase spacing therebetween.

28. A rotary turbine fluid pump as set forth in claim 25, wherein said second wall section of said pump housing opposes said second surface of turbine, and one of said second wall section and said second surface inclines inwardly to gradually increase spacing therebetween.

29. A rotary turbine fluid pump comprising:

a rotary turbine having a plurality of turbine vanes which are arranged on the outer circumference thereof and which are rotatingly driven by means of a driving means, said rotary turbine having a pair of surfaces at its both axis ends;

a pump housing defining therein a pumping chamber connected to an inlet for introducing fluid therethrough and to an outlet for discharging pressurized fluid therefrom, said pump housing having wall sections mating portions mating with said surfaces of said turbine; a portion of said wall section being inclined so as to gradually increase clearance between said wall section and said surface of said turbine toward the center, the difference of clearance at inner and outer ends thereof being in a range of 5 $\mu$m to 20 $\mu$m;

means for defining sealing chambers between said surfaces and said wall sections for establishing a floating seal therebetween; and means for introducing pressurized fluid into said sealing chambers which defines a pressurized fluid path connected to said sealing chambers and a gradually reducing path area toward said sealing chamber.

30. A rotary turbine fluid pump comprising: a rotary turbine formed of a reinforced plastic comprising a glass matrix with phenol resin and a binder, said turbine having a plurality of turbine vanes which are arranged on the outer circumference thereof, driving means for rotatingly driving said turbine vanes, said rotary turbine having a pair of surfaces at its both axis ends;

a pump housing defining therein a pumping chamber connected to an inlet for introducing fluid therethrough and to an outlet for discharging pressurized fluid therefrom, said pump housing having wall sections mating portions mating with said surfaces of said turbine;

means for defining sealing chambers between said surfaces and said wall sections for establishing a floating seal therebetween; and means for introducing pressurized fluid into said sealing chambers which defines a pressurized fluid path connected to said sealing chambers and a gradually reducing path area toward said sealing chamber.

* * * * *